US011412332B2

(12) United States Patent
Kohl et al.

(10) Patent No.: US 11,412,332 B2
(45) Date of Patent: Aug. 9, 2022

(54) SYSTEMS AND METHODS FOR DATA EXCHANGE BETWEEN BINAURAL HEARING DEVICES

(71) Applicant: SONOVA AG, Staefa (CH)

(72) Inventors: Manuel Christoph Kohl, Hannover (DE); Joachim Thiemann, Hannover (DE); Raphael S. Koning, Wedemark (DE); Josef Chalupper, Paunzhausen (DE)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/085,914

(22) Filed: Oct. 30, 2020

(65) Prior Publication Data

US 2022/0141599 A1 May 5, 2022

(51) Int. Cl.
*H04R 25/00* (2006.01)

(52) U.S. Cl.
CPC ..... *H04R 25/407* (2013.01)

(58) Field of Classification Search
CPC ..... H04R 25/00; H04R 25/55; H04R 25/558
USPC ..... 381/312–331, 380–381
See application file for complete search history.

(56) References Cited

U.S. PATENT DOCUMENTS 6,549,633 B1 * 4/2003 Westermann ..... H04R 25/453 381/312
2007/0116308 A1 * 5/2007 Zurek ..... H04R 25/554 381/312
2007/0291969 A1 * 12/2007 Tateno ..... H04R 25/552 381/315
2015/0358438 A1 * 12/2015 Kim ..... H04M 1/026 455/566
2016/0127842 A1 * 5/2016 Perels ..... H04R 25/305 381/23.1
2019/0132687 A1 5/2019 Santos et al.
(Continued)

FOREIGN PATENT DOCUMENTS

EP 2341718 A2 7/2011
EP 3054706 8/2016
(Continued)

OTHER PUBLICATIONS

"Extended European Search Report received in EP Application No. 21198303.6-1210 dated Mar. 23, 2022".

*Primary Examiner* — Suhan Ni
(74) *Attorney, Agent, or Firm* — ALG Intellectual Property, LLC

(57) ABSTRACT

An exemplary system comprises a first and second hearing device associated with a first and second ear of a user, respectively. The first hearing device is configured to detect a first audio signal representative of audio content, generate a first intermediate signal representation (ISR) corresponding to the first audio signal, the first ISR comprising a sparsely-encoded non-audio signal having a complexity measure that is below a threshold, and transmit the first ISR to the second hearing device. The second hearing device is configured to detect a second audio signal representative of the audio content, generate a second ISR corresponding to the second audio signal, and transmit the second ISR to the first hearing device. The first hearing device is further configured to generate, based on the first and second ISRs, an output audio signal, and provide the output audio signal to the first ear of the user.

17 Claims, 6 Drawing Sheets

(56) References Cited

U.S. PATENT DOCUMENTS

| | | | | |
|---|---|---|---|---|
| 2019/0340493 | A1 | 11/2019 | Coenen et al. | |
| 2021/0136501 | A1* | 5/2021 | Ma | H04R 25/552 |
| 2021/0352420 | A1* | 11/2021 | Liu | H04R 25/552 |

FOREIGN PATENT DOCUMENTS

| | | | |
|---|---|---|---|
| EP | 3229496 | | 10/2017 |
| EP | 2928214 | | 5/2019 |
| WO | 2007128825 | A1 | 11/2007 |
| WO | 2009153718 | | 12/2009 |
| WO | 2018060829 | | 4/2018 |
| WO | 2019084405 | | 5/2019 |

* cited by examiner

SYSTEMS AND METHODS FOR DATA EXCHANGE BETWEEN BINAURAL HEARING DEVICES

BACKGROUND INFORMATION

A binaural hearing system may include a first hearing device worn behind a first ear of a user and a second hearing device worn behind a second ear of the user. In this configuration, the binaural hearing devices may simultaneously convey sound to both ears of the user. For example, the hearing devices may be implemented by hearing aids configured to provide an amplified version of audio content to the user to enhance hearing by the user.

Hearing devices conventionally have inbuilt microphones configured to detect audio signals presented to the user. Binaural hearing devices may provide various benefits using frontend digital signal processing algorithms involving beamforming, noise reduction, and dynamic range adjustment. However, to maximize the performance of such algorithms, the hearing devices may need to process audio signals as detected by both hearing devices. Thus, the hearing devices may need to transmit audio information to each other. Unfortunately, such transmission may be bandwidth limited and consume a relatively high amount of power.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Exemplary systems and methods for data exchange between binaural hearing devices are described herein. For example, a system may comprise a first hearing device associated with a first ear of a user and a second hearing device associated with a second ear of the user. The first hearing device may be configured to detect a first audio signal representative of audio content, and generate a first intermediate signal representation (ISR) corresponding to the first audio signal, the first ISR comprising a sparsely-encoded non-audio signal having a complexity measure that is below a threshold. The first hearing device may be further configured to transmit the first ISR to the second hearing device. The second hearing device may be configured to detect a second audio signal representative of the audio content, and generate a second ISR corresponding to the second audio signal, the second ISR having the complexity measure that is below the threshold. The second hearing device may be further configured to transmit the second ISR to the first hearing device. The first hearing device may be further configured to generate, based on the first and second ISRs, an output audio signal, and provide the output audio signal to the first ear of the user. Likewise, the second hearing device may be further configured to generate, based on the first and second ISRs, an output audio signal, and provide the output audio signal to the second ear of the user.

The systems and methods described herein may advantageously provide many benefits to users of binaural hearing devices. For example, the hearing devices described herein may provide audio signals that more accurately replicate audio content as perceived by normal hearing than conventional hearing systems. Moreover, the systems and methods described herein provide ISRs that encode the audio information as non-audio signals so that the relevant information may be transmitted between the hearing devices using less bandwidth and operating power than transmitting audio signals or data with an audio signal bitrate. For at least these reasons, the binaural systems and methods described herein may advantageously provide additional functionality and/or features for hearing device users compared to conventional binaural hearing systems. These and other benefits of the systems and methods described herein will be made apparent herein.

Figure 1:
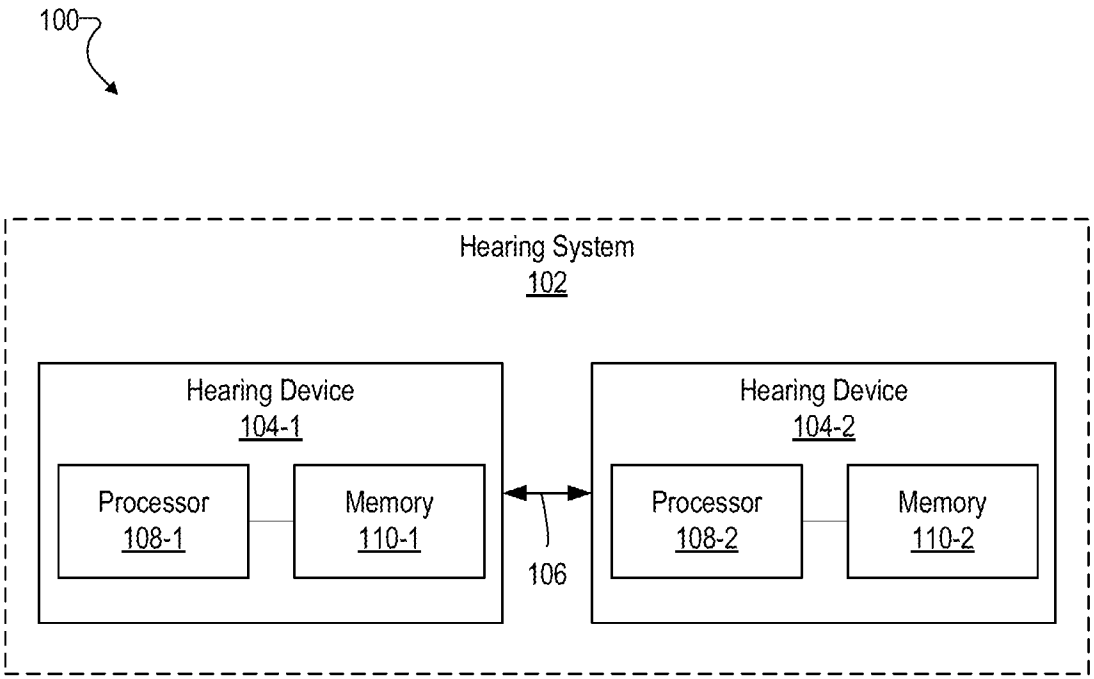
FIG. 1 illustrates an exemplary hearing system according to principles described herein.

FIG. 1 illustrates an exemplary configuration 100 of a binaural hearing system 102 (or simply hearing system 102). As shown, hearing system 102 includes a first hearing device 104-1 and a second hearing device 104-2 (collectively "hearing devices 104"). Hearing devices 104 may communicate one with another by way of a wireless communication link 106.

Hearing devices 104 may each be implemented by any type of hearing device configured to provide or enhance hearing to a user of hearing system 102. For example, hearing devices 104 may each be implemented by a hearing aid configured to apply amplified audio content to a user, a sound processor included in a cochlear implant system configured to apply electrical stimulation representative of audio content to a user, a sound processor included in an electro-acoustic stimulation system configured to apply electro-acoustic stimulation to a user, a head-worn headset, an ear-worn ear-bud or any other suitable hearing device. In some examples, hearing device 104-1 is of a different type than hearing device 104-2. For example, hearing device 104-1 may be a hearing aid and hearing device 104-2 may be a sound processor included in a cochlear implant system. As another example, hearing device 104-1 may be a unilateral hearing aid and hearing device 104-2 may be a contralateral routing of signals (CROS) hearing aid.

As shown, each hearing device 104 includes a processor and a memory. For example, hearing device 104-1 includes a processor 108-1 and a memory 110-1. Likewise, hearing device 104-2 includes a processor 108-2 and a memory 110-2.

Processors 108 (e.g., processor 108-1 and processor 108-2) are configured to perform various processing operations, such as processing audio content received by hearing devices 104 and transmitting data to each other. Processors 108 may each be implemented by any suitable combination of hardware and software.

Memories 110 (e.g., memory 110-1 and memory 110-2) may be implemented by any suitable type of non-transitory computer readable storage medium and may maintain (e.g., store) data utilized by processors 108. For example, memories 110 may store data representative of an operation program that specifies how each processor 108 processes and delivers audio content to a user. To illustrate, if hearing device 104-1 is a hearing aid, memory 110-1 may maintain data representative of an operation program that specifies an audio amplification scheme (e.g., amplification levels, etc.) used by processor 108-1 to deliver acoustic content to the user. As another example, if hearing device 104-1 is a sound processor included in a cochlear implant system, memory 110-1 may maintain data representative of an operation program that specifies a stimulation scheme used by hearing device 104-1 to direct a cochlear implant to apply electrical stimulation representative of acoustic content to the user.

Hearing devices 104 may communicate with each other (e.g., by transmitting data) by way of a wireless communication link 106 that interconnects hearing devices 104. Wireless communication link 106 may include any suitable wireless communication link as may serve a particular implementation.

Figure 2:
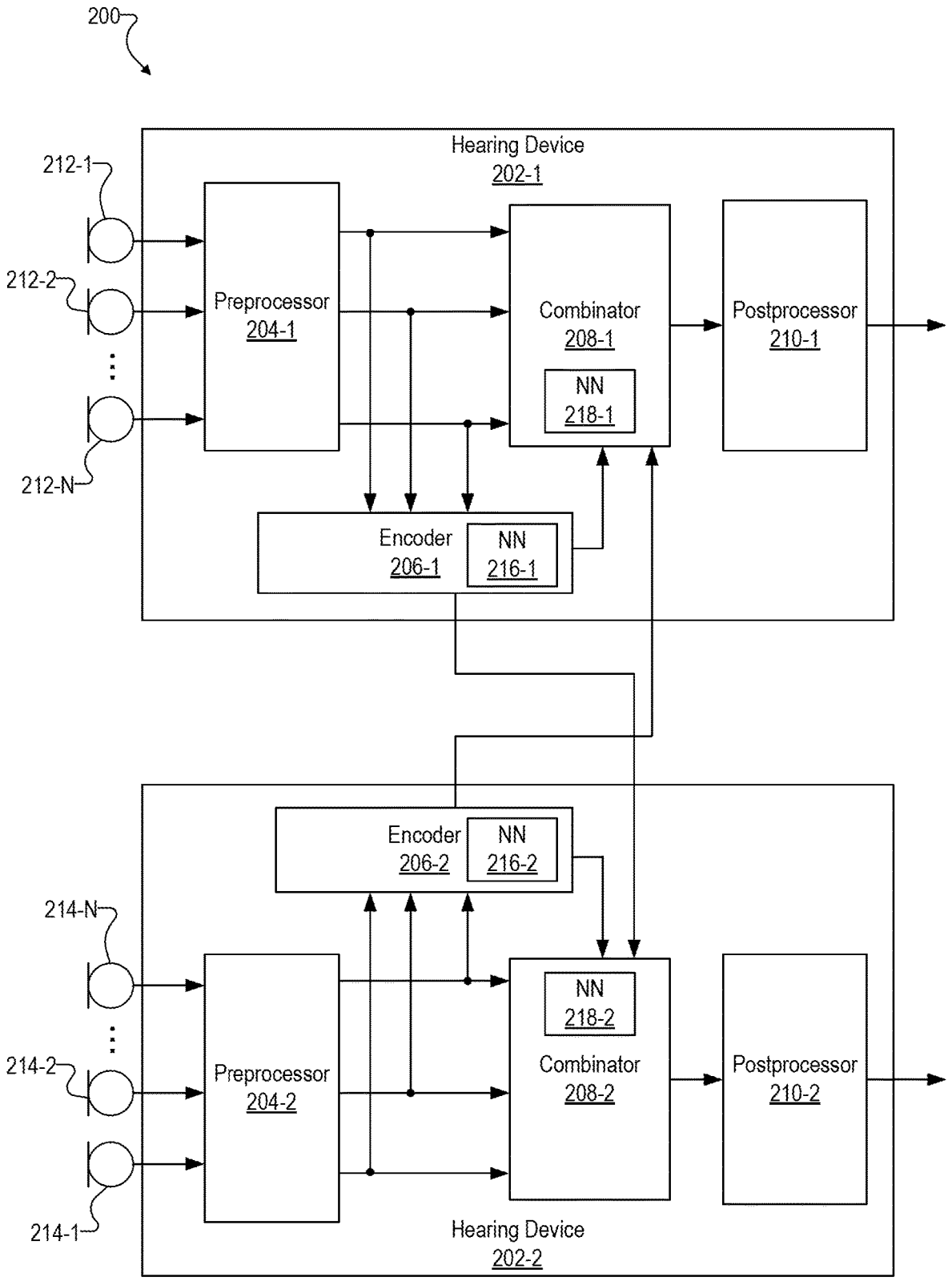
FIG. 2 illustrates an exemplary configuration for data exchange according to principles described herein.

FIG. 2 illustrates an exemplary configuration 200 of a binaural hearing system (e.g., hearing system 102). Configuration 200 includes hearing devices 202 (e.g., hearing device 202-1 and hearing device 202-2), which may each be configured to be associated with an ear of a user. As used herein, a hearing device "associated with" an ear of a user is configured to be used to provide an output audio signal to the ear. For example, hearing device 202-1 may be worn on or within a right ear of the user and configured to provide an output audio signal to the right ear. Likewise, hearing device 202-2 may be worn on or within a left ear of the user and configured to provide an output audio signal to the left ear.

As shown, hearing device 202-1 includes a preprocessor 204-1, an encoder 206-1, a combinator 208-1, and a postprocessor 210-1. Similarly, hearing device 202-2 includes a preprocessor 204-2, an encoder 206-2, a combinator 208-2, and a postprocessor 210-2. Preprocessors 204, encoders 206, combinators 208, and postprocessors 210 may each be implemented as a software/firmware module, a hardware circuit, and/or any suitable combination of hardware and software/firmware. For example, preprocessors 204, encoders 206, combinators 208, and postprocessors 210 may be implemented in one or more processors (e.g., processor 108) of hearing devices 202.

Hearing device 202-1 further includes an array of microphones 212 (e.g., microphones 212-1 through 212-N). Likewise, hearing device 202-2 also includes an array of microphones 214 (e.g., microphones 214-1 through 214-N). Each of microphones 212 and microphones 214 may be implemented by any suitable audio detection device and is configured to detect an audio signal provided to a user of hearing devices 202. The audio signal may include, for example, audio content (e.g., music, speech, noise, etc.) generated by one or more audio sources included in an environment of the user, including the user. Microphones 212 and microphones 214 may be included in or communicatively coupled to hearing device 202-1 and hearing device 202-2, respectively, in any suitable manner.

Microphones 212 may be configured to detect audio content from different locations, such as different positions on hearing device 202-1. Microphones 214 may be likewise configured to detect audio content from different locations, such as different positions on hearing device 202-2. Further, microphones 214 may detect the audio content from locations different from microphones 212 as well as each other. For instance, as hearing device 202-1 and hearing device 202-2 are configured for different ears of the user, audio signals detected by microphones 212 and microphones 214 of a same audio content may vary based on the environment of the user, including directions of sources of the audio content, absorption and reflection off of objects and people (including the user) in the environment, etc.

The audio signals detected by microphones 212 may be received by preprocessor 204-1, which may perform various preprocessing functions on the audio signals. For example, preprocessor 204-1 may perform analog-to-digital (A/D) conversion, filtering, compression, and/or any other suitable preprocessing algorithms on the audio signals. Preprocessor 204-1 may perform the preprocessing on each of the audio signals individually and output the preprocessed audio signals, outputting a same number of signals as received from microphones 212. Preprocessor 204-1 may output the preprocessed audio signals to both encoder 206-1 and combinator 208-1. Similarly, preprocessor 204-2 may receive audio signals detected by microphones 214 and perform various preprocessing functions on the audio signals received. Preprocessor 204-2 may likewise output the preprocessed audio signals to encoder 206-2 and combinator 208-2.

Encoder 206-1 may receive the preprocessed audio signals from preprocessor 204-1 and generate an intermediate signal representation (ISR) corresponding to the preprocessed audio signals. The ISR may be configured to encode the information from the preprocessed audio signals most relevant to reconstructing the preprocessed audio signals for further processing, such as for beamforming, noise reduction, etc. However, the ISR may also be configured with a threshold complexity so that the ISR may be transmitted efficiently, such as via a low-latency wireless connection or any such suitable connection (e.g., wireless communication link 106). Thus, the ISR may be implemented as any suitable latent representation of the audio signals, such as a signal that encodes the audio signals received by encoder 206-1 with a lower dimensionality than the audio signals. For instance, the ISR may be a sparsely-encoded (e.g., an encoding of data comprising mostly zeros relative to non-zeros) non-audio signal that corresponds to a combination of the preprocessed audio signals.

In some examples, encoder 206-1 may be implemented, at least in part, using a machine learning algorithm such as a neural network 216-1. Neural network 216-1 may include any suitable neural network, such as an artificial neural network (ANN), a convolutional neural network (CNN), a recurrent neural network (RNN), etc. In some examples, neural network 216-1 may be implemented in encoder 206-1 using a dedicated ANN accelerator. Neural network 216-1 may be trained to receive the preprocessed audio signals and generate the ISR based on the received audio signals. The training of neural network 216-1 may configure the ISR to optimize parameters for reconstruction of the audio signal while minimizing complexity of the ISR. The training of neural network 216-1 is described further herein.

In some examples, encoder 206-1 may further compress and/or sub-sample the generated ISR (which may itself also be considered an ISR). Encoder 206-1 outputs the ISR to hearing device 202-2 (e.g., combinator 208-2). Similarly, encoder 206-2 may encode preprocessed audio signals received from preprocessor 204-2 and output an ISR corresponding to the audio signals received by hearing device 202-2 to hearing device 202-1 (e.g., combinator 208-1).

Combinator 208-1 may receive the ISR corresponding to the audio signals received by hearing device 202-2, as well as the preprocessed audio signals from preprocessor 204-1. Further, in some examples, combinator 208-1 may receive the ISR generated by encoder 206-1 that is transmitted to hearing device 202-2. Combinator 208-1 may generate an output audio signal based on these received input signals. In some examples, combinator 208-1 may include a machine learning algorithm such as a neural network 218-1 that is configured to generate the output audio signal based on the input signals. Neural network 218-1 may include any suitable neural network and may be trained to work with neural network 216-1 to optimize the configuration of the ISRs and the output audio signal reconstructed from the ISRs. In some examples, neural network 218-1 may be implemented in combinator 208-1 using a dedicated ANN accelerator. The training of neural network 218-1 is described further herein.

Generating the output audio signal by combinator 208-1 may include additional processing of the ISRs. For example, combinator 208-1 may process the ISRs to replicate the audio content as experienced by normal hearing, which may include algorithms to compensate for the positioning of microphones 214 that result in differences in the detected audio signals from audio signals detected by a normal-hearing ear (e.g., filtering by a pinna of the ear, reduced ability to localize sound sources, reduced speech intelligibility, reduced parsing of complex auditory scenes, etc.). Such processing may include algorithms such as beamforming, noise reduction, dynamic range adjustment, sound quality enhancement, dereverberation, adaptive spatial directivity adjustment, etc. The information from the audio signals that is used for such algorithms may vary depending on the algorithm. Thus the ISRs may be configured based on the processing that is to be performed by combinator 208-1, which may vary based on a sound environment of the user, a sound processing program of hearing device 202-1, etc. Further, parameters of combinator 208-1 (e.g., neural network 218-1) may be optimized for the processing performed by combinator 208-1.

The audio signal output by combinator 208-1 may be received by postprocessor 210-1. Postprocessor 210-1 may perform various postprocessing functions on the output audio signal. For example, postprocessor 210-1 may perform filtering, compression, digital-to-analog (D/A) conversion, and/or any other suitable postprocessing on the audio signals. Postprocessor 210-1 may provide the postprocessed audio signal to the ear of the user. In some examples, postprocessor 210-1 and/or its functionality may be omitted and the output audio signal provided by combinator 208-1 may be provided to the user.

Similarly, combinator 208-2 may generate an output audio signal to be provided to a corresponding ear of the user based on input signals received from encoder 206-1, encoder 206-2, and preprocessor 204-2. Postprocessor 210-2 may also perform various postprocessing functions on the output audio signal. The output audio signals provided to the user by hearing devices 202 may thus be processed to provide audio signals representing audio content as would be experienced with normal hearing, including binaural cues.

Figure 3:
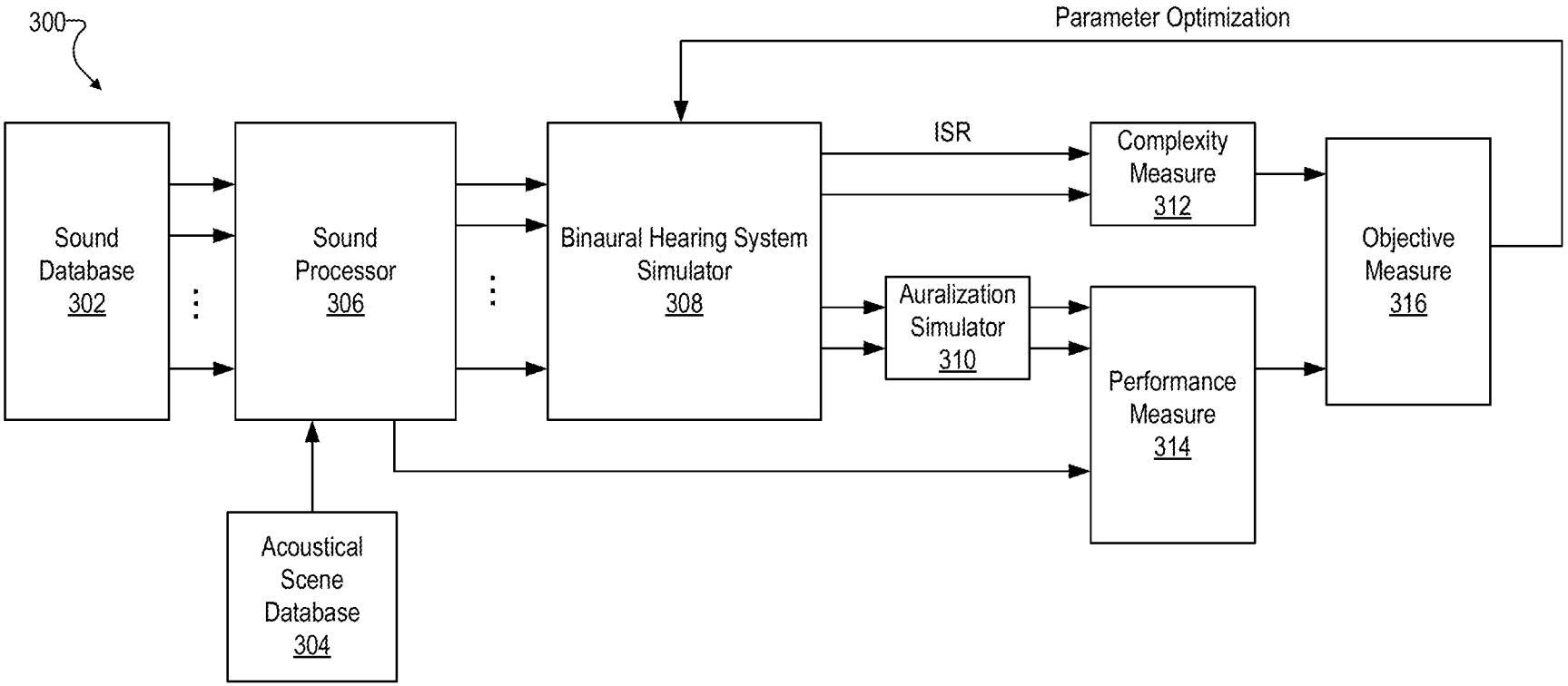
FIG. 3 illustrates an exemplary configuration for parameter optimization according to principles described herein.

FIG. 3 illustrates exemplary configuration 300 for parameter optimization for data exchange between binaural hearing devices. Configuration 300 may be implemented on any suitable processor, including a processor on a hearing device (e.g., hearing devices 202), one or more processors in a computer, a supercomputer, a network of computers, etc. Configuration 300 includes a sound database 302, an acoustical scene database 304, a sound processor 306, a binaural hearing system simulator 308, an auralization simulator 310, a complexity measure module 312, a performance measure module 314, and an objective measure module 316. Components of configuration 300 may each be combined into fewer components, further subdivided into more components, and/or implemented on one or more processors and/or devices.

As shown, sound processor 306 may receive inputs from a sound database 302 and an acoustical scene database 304. For instance, sound database 302 may include data representative of characteristic sounds (e.g., speech, music, noise, ambient background noise, etc.) that may be encountered in a wide variety of sound environments. Acoustical scene database 304 may include data representative of various types of environments in which the sounds from sound database 302 may be inserted and altered based on the environment (e.g., a moving car, a concert hall, over a phone, etc.).

Sound processor 306 may receive sets of inputs from sound database 302 and acoustical scene database 304 that simulate audio content that may be encountered in one or more specific sound environments. Sound processor 306 may process the inputs to generate a simulated sound environment and simulated microphone input of the audio content as would be detected by microphones of a hearing system (e.g., microphones 212 and 214 of configuration 200) in the simulated sound environment. Sound processor 306 may process the inputs to generate such a simulation using any suitable algorithms, such as amplification, sound staging, reverberation, microphone head-related transfer functions (HRTF), etc.

Sound processor 306 may provide the simulated microphone input to binaural hearing system simulator 308. Binaural hearing system simulator may simulate functionality of a hearing system such as hearing devices 202. Thus, binaural hearing system simulator 308 may generate ISRs associated with the simulated microphone inputs received from sound processor 306 and output audio signals that would be provided to a user of the hearing system. Binaural hearing system simulator 308 may output the generated ISRs to complexity measure module 312 and the output audio signals to auralization simulator 310.

Auralization simulator 310 may receive the output audio signals generated by binaural hearing system simulator 308 and simulate how such audio signals would be perceived by the user. Thus, in some examples, auralization simulator 310 may include an individualized hearing model of the user that models a specific user's hearing loss. In other examples, auralization simulator 310 may base the simulation on a generic or generalized hearing model. Auralization simulator 310 provides a simulated audio output to performance measure module 314.

Performance measure module 314 receives the simulated audio output from auralization simulator 310 as well as an input reference from sound processor 306. The input reference may be any suitable audio signal that is used to compare to the output audio signal generated by binaural hearing system simulator 308 based on a reconstructing and processing of ISRs. For example, the input reference may be the original simulated audio content generated by sound processor 306. Additionally or alternatively, the input reference may be the simulated microphone input of the audio content. Additionally or alternatively, the input reference may be the audio content processed by an auralization simulation. Additionally or alternatively, the input reference may be an idealized output of hearing devices 202.

Performance measure module 314 may compare the inputs received from auralization simulator 310 to the input reference to determine a performance measure of binaural hearing system simulator 308. Specifically, the performance measure may gauge an effectiveness of a set of parameters for an encoding of the ISRs (e.g., encoders 206) and a reconstructing of audio signals from the ISRs (e.g., combinators 208) to generate output audio signals that replicate the audio content as experienced by normal hearing. For example, the performance measure may include metrics such as speech intelligibility index, perceptual evaluation of speech quality (PESQ), speech transmission index (STI), mean opinion score, etc., while the parameters may include weights for neural networks for encoders 206 and combinators 208. In some examples, the performance measure module 314 may also be implemented using a machine learning algorithm, such as a neural network.

Complexity measure module 312 receives the ISRs generated by binaural hearing system simulator 308. Complexity measure module 312 may determine any suitable complexity measure of the ISRs. The complexity measure may be any objective measure of resources required to transmit the ISRs, such as an average bitrate of the ISRs.

Objective measure module 316 may receive the complexity measure output by complexity measure module 312 and the performance measure output by performance measure module 314. Objective measure module 316 may determine an overall objective measure of the binaural hearing system simulator 308 based on the performance measure and the complexity measure. For example, the overall objective measure may be any suitable combination of the performance measure and the complexity measure to maximize the performance of the audio signal output by binaural hearing system simulator 308 while generating ISRs having a complexity measure that is below a predetermined threshold complexity measure. The predetermined threshold complexity measure may be representative of any suitable complexity level, which may be based on a capacity of a communication link between hearing devices of the binaural hearing system. For example, a threshold complexity measure may be representative of an average bitrate of the ISRs, such as anywhere between 1 and 100 kilobits per second (kbps) or any other suitable bitrate. The threshold complexity measure may additionally or alternatively be any other suitable metric as may serve a particular implementation.

Objective measure module 316 provides the overall objective measure to binaural hearing system simulator 308 so that the machine learning algorithms (e.g., neural networks 216 and 218) may be trained based on the feedback. For example, binaural hearing system simulator 308 may adjust, based on the overall objective measure, one or more parameters of encoder 306 (e.g., neural networks 216) and/or combinators 208 (e.g., neural networks 218) to determine optimal configurations of the ISRs and for generating and reconstructing the ISRs. Additionally or alternatively, such adjustments may be made based on the performance measure and/or the complexity measure. In some examples, the adjusting of parameters may be performed successively and/or iteratively, such as an adjusting of parameters of encoders 306 while keeping parameters of combinators 308 the same and then vice versa.

As the hearing system (e.g., neural networks 216 and 218) is trained using audio content from simulated sound environments, any suitable number of sound environments may be generated to provide input for the training. Furthermore, as described, the optimization of the ISRs may include configuring different ISRs for different circumstances, which may include sound environments, acoustical scenes, sound processing programs, individualized hearing loss models, etc. In some examples, the ISRs may be further optimized for individualization in a fitting session for a user or by the user via a mobile app.

In some examples, configuration 300 may be implemented on the hearing system (e.g., hearing devices 202), in which case audio content may be detected from actual sound environments rather than simulated sound environments and binaural hearing system simulator 308 may instead be the actual hearing system. In such cases, the hearing system may continue to optimize while in use (or during specific training periods). The hearing system may receive additional input from the user (e.g., indications of improved or worsening performance) for such optimization.

Figure 4:
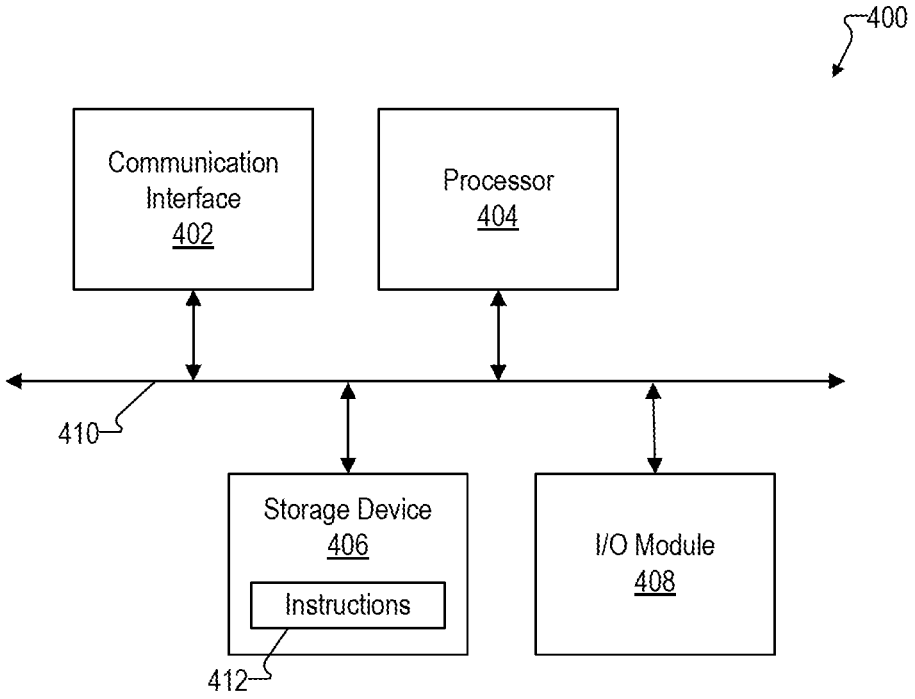
FIG. 4 illustrates an exemplary computing device according to principles described herein.

FIG. 4 illustrates an exemplary computing device 400 that may be specifically configured to perform one or more of the processes described herein. Any of the systems, units, computing devices, and/or other components described herein may be implemented by computing device 400.

As shown in FIG. 4, computing device 400 may include a communication interface 402, a processor 404, a storage device 406, and an input/output ("I/O") module 408 communicatively connected one to another via a communication infrastructure 410. While an exemplary computing device 400 is shown in FIG. 4, the components illustrated in FIG. 4 are not intended to be limiting. Additional or alternative components may be used in other embodiments. Components of computing device 400 shown in FIG. 4 will now be described in additional detail.

Communication interface 402 may be configured to communicate with one or more computing devices. Examples of communication interface 402 include, without limitation, a wired network interface (such as a network interface card), a wireless network interface (such as a wireless network interface card), a modem, an audio/video connection, and any other suitable interface.

Processor 404 generally represents any type or form of processing unit capable of processing data and/or interpreting, executing, and/or directing execution of one or more of the instructions, processes, and/or operations described herein. Processor 404 may perform operations by executing computer-executable instructions 412 (e.g., an application, software, code, and/or other executable data instance) stored in storage device 406.

Storage device 406 may include one or more non-transitory computer readable data storage media, devices, or configurations and may employ any type, form, and combination of data storage media and/or device. For example, storage device 406 may include, but is not limited to, any combination of the non-volatile media and/or volatile media described herein. Electronic data, including data described herein, may be temporarily and/or permanently stored in storage device 406. For example, data representative of computer-executable instructions 412 configured to direct processor 404 to perform any of the operations described herein may be stored within storage device 406. In some examples, data may be arranged in one or more databases residing within storage device 406.

I/O module 408 may include one or more I/O modules configured to receive user input and provide user output. I/O module 408 may include any hardware, firmware, software, or combination thereof supportive of input and output capabilities. For example, I/O module 408 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 408 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 408 is configured to provide graphical data to a display for presentation to a user. The graphical data may be representative of one or more graphical user interfaces and/or any other graphical content as may serve a particular implementation.

Figure 5:
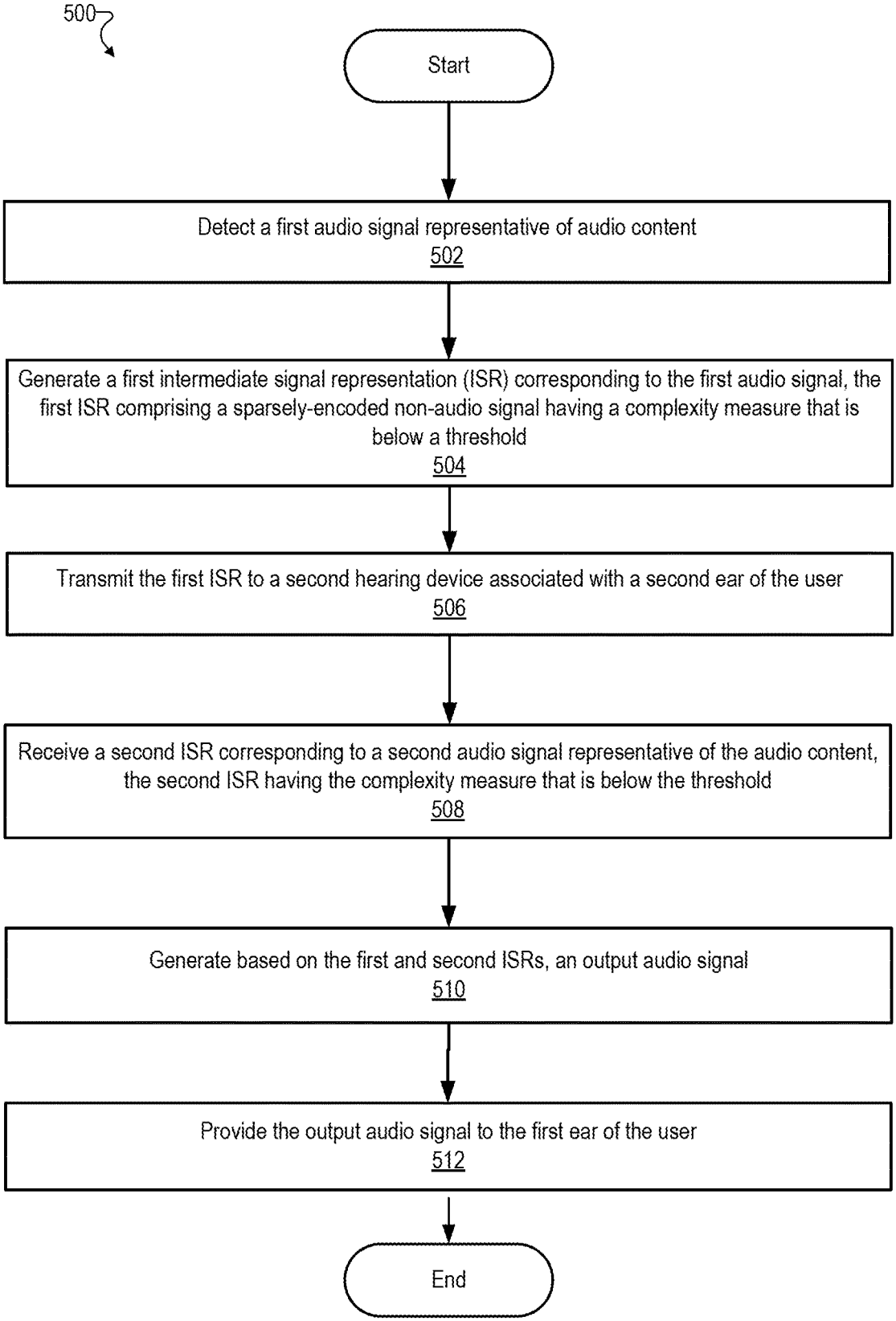
FIGS. 5-6 illustrate exemplary methods according to principles described herein.

FIG. 5 illustrates an exemplary method 500. One or more of the operations shown in FIG. 5 may be performed by any of the hearing devices described herein. While FIG. 5 illustrates exemplary operations according to one embodiment, other embodiments may omit, add to, reorder, and/or modify any of the operations shown in FIG. 5. Each of the operations shown in FIG. 5 may be performed in any of the ways described herein.

At operation 502, a hearing device configured to be associated with a first ear of a user detects a first audio signal representative of audio content.

At operation 504, the hearing device generates a first ISR corresponding to the first audio signal, the first ISR comprising a sparsely-encoded non-audio signal having a complexity measure that is below a threshold.

At operation 506, the hearing device transmits the first ISR to a second hearing device associated with a second ear of the user.

At operation 508, the hearing device receives a second ISR corresponding to a second audio signal representative of the audio content, the second ISR having the complexity measure that is below the threshold.

At operation 510, the hearing device generates based on the first and second ISRs, an output audio signal.

At operation 512, the hearing device provides the output audio signal to the first ear of the user.

Figure 6:
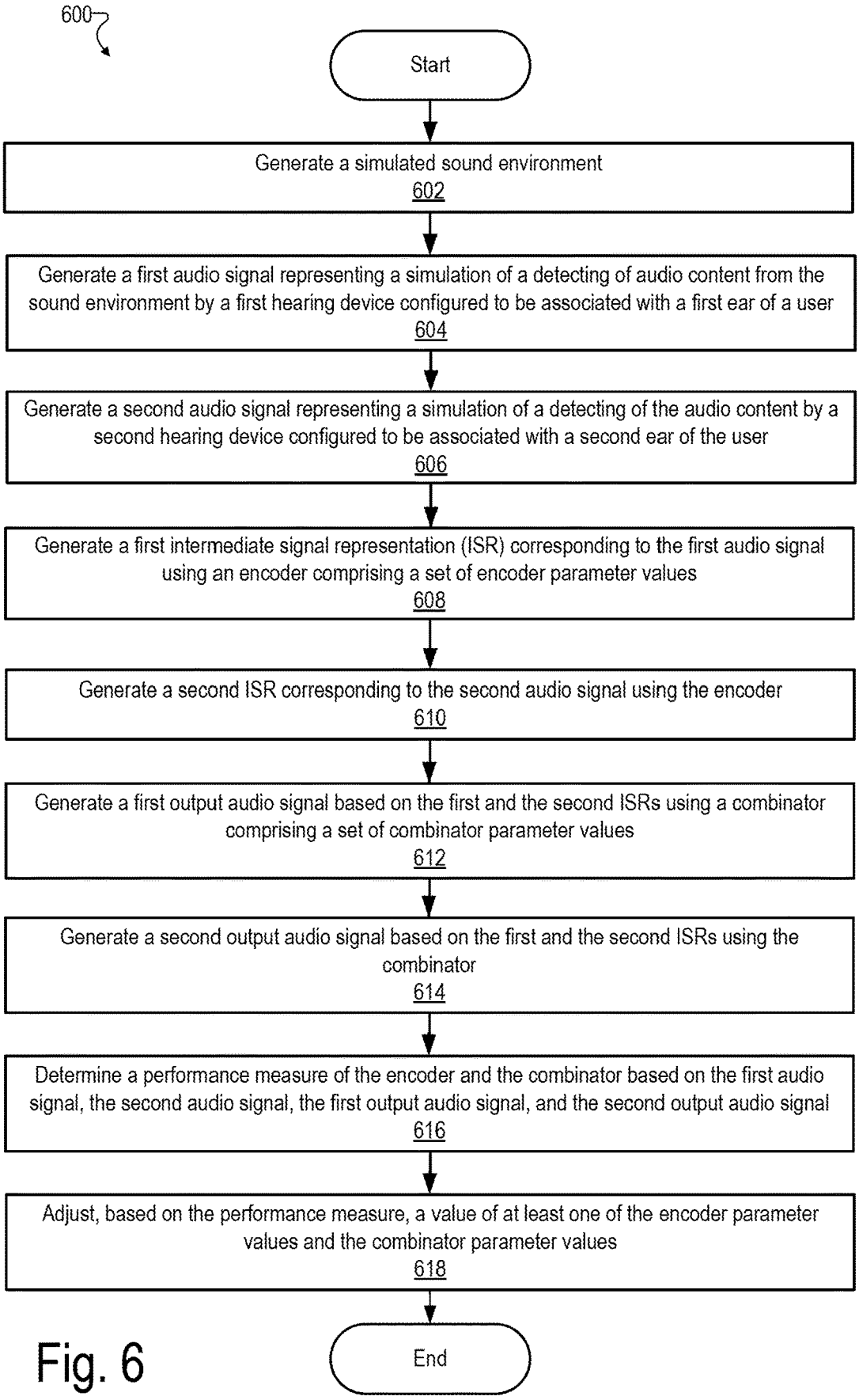

FIG. 6 illustrates an exemplary method 600. One or more of the operations shown in FIG. 6 may be performed by any of the processors described herein. While FIG. 6 illustrates exemplary operations according to one embodiment, other embodiments may omit, add to, reorder, and/or modify any of the operations shown in FIG. 6. Each of the operations shown in FIG. 6 may be performed in any of the ways described herein.

At operation 602, a processor generates a simulated sound environment.

At operation 604, the processor generates a first audio signal representing a simulation of a detecting of audio content from the sound environment by a first hearing device configured to be associated with a first ear of a user.

At operation 606, the processor generates a second audio signal representing a simulation of a detecting of the audio content by a second hearing device configured to be associated with a second ear of the user.

At operation 608, the processor generates a first intermediate signal representation (ISR) corresponding to the first audio signal using an encoder comprising a set of encoder parameter values.

At operation 610, the processor generates a second ISR corresponding to the second audio signal using the encoder.

At operation 612, the processor generates a first output audio signal based on the first and the second ISRs using a combinator comprising a set of combinator parameter values.

At operation 614, the processor generates a second output audio signal based on the first and the second ISRs using the combinator.

At operation 616, the processor determines a performance measure of the encoder and the combinator based on the first audio signal, the second audio signal, the first output audio signal, and the second output audio signal.

At operation 618, the processor adjusts, based on the performance measure, a value of at least one of the encoder parameter values and the combinator parameter values.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A system comprising:

a first hearing device associated with a first ear of a user and a second hearing device associated with a second ear of the user;

the first hearing device configured to:

detect a first audio signal representative of audio content, generate a first intermediate signal representation (ISR) based on the first audio signal, the first ISR comprising a signal encoding the first audio signal and having a complexity measure that is below a threshold, and transmit the first ISR to the second hearing device;

the second hearing device configured to:

detect a second audio signal representative of the audio content, generate a second ISR based on the second audio signal, the second ISR comprising a signal encoding the second audio signal and having the complexity measure that is below the threshold, and transmit the second ISR to the first hearing device;

the first hearing device further configured to:

generate, based on the first and second ISRs, an output audio signal, and provide the output audio signal to the first ear of the user.

2. The system of claim 1, wherein the second hearing device further configured to:

generate, based on the first and second ISRs, an additional output audio signal; and provide the additional output audio signal to the second ear of the user.

3. The system of claim 1, wherein the generating the first ISR comprises using a first machine learning algorithm and the generating the second ISR comprises using a second machine learning algorithm.

4. The system of claim 3, wherein the first machine learning algorithm and the second machine learning algorithm include a same algorithm.

5. The system of claim 3, wherein the generating the output audio signal comprises using a third machine learning algorithm.

6. The system of claim 5, wherein:

the first machine learning algorithm comprises a first neural network;

the second machine learning algorithm comprises a second neural network;

the third machine learning algorithm comprises a third neural network; and the first hearing device is further configured to select parameters for at least one of the first neural network and the third neural network based on at least one of an environment of the user and a hearing loss model of the user.

7. The system of claim 6, wherein:

the first hearing device is further configured to select a processing algorithm for generating the output audio signal; and the selecting the parameters for the at least one of the first neural network and the third neural network is further based on the selecting the processing algorithm for the generating the output audio signal.

8. The system of claim 1, wherein:

the first hearing device is further configured to detect a third audio signal representative of the audio content;

the generating the first ISR comprises generating the first ISR to correspond to a combination of the first and third audio signals;

the second hearing device is further configured to detect a fourth audio signal representative of the audio content; and the generating the second ISR comprises generating the second ISR to correspond to a combination of the second and fourth audio signals.

9. The system of claim 8, wherein the generating the output audio signal comprises processing the first and second ISRs using a beamforming algorithm.

10. The system of claim 8, wherein the generating the output audio signal comprises processing the first and second ISRs for adaptive spatial directivity adjustment.

11. The system of claim 1, wherein:

the first hearing device comprises a first artificial neural network (ANN) accelerator configured to generate the first ISR; and the second hearing device comprises a second ANN accelerator configured to generate the second ISR.

12. A method comprising:

detecting, by a first hearing device associated with a first ear of a user, a first audio signal representative of audio content;

generating, by the first hearing device, a first intermediate signal representation (ISR) based on the first audio signal, the first ISR comprising a signal encoding the first audio signal and having a complexity measure that is below a threshold;

transmitting, by the first hearing device, the first ISR to a second hearing device associated with a second ear of the user;

receiving, by the first hearing device, a second ISR based on a second audio signal representative of the audio content, the second ISR comprising a signal encoding the second audio signal and having the complexity measure that is below the threshold;

generating, by the first hearing device, based on the first and second ISRs, an output audio signal; and providing, by the first hearing device, the output audio signal to the first ear of the user.

13. The method of claim 12, wherein:

the generating the first ISR comprises using a first machine learning algorithm; and the generating the output audio signal comprises using a second machine learning algorithm.

14. The method of claim 13, wherein:

the first machine learning algorithm comprises a first neural network;

the second machine learning algorithm comprises a second neural network; and the method further comprises selecting, by the first hearing device, parameters for at least one of the first neural network and the second neural network based on at least one of an environment of the user and a hearing loss model of the user.

15. The method of claim 14, further comprising selecting, by the first hearing device, a processing algorithm for generating the output audio signal;

wherein the selecting the parameters for the at least one of the first neural network and the second neural network is further based on the selecting the processing algorithm for the generating the output audio signal.

16. The method of claim 12, further comprising detecting, by the first hearing device, a third audio signal representative of the audio content, and wherein:

the generating the first ISR comprises generating the first ISR to correspond to a combination of the first and third audio signals.

17. The method of claim 16, wherein the generating the output audio signal comprises processing the first and second ISRs using at least one of a beamforming algorithm and an adaptive spatial directivity adjustment algorithm.

* * * * *